US006785481B2

(12) United States Patent
Bray et al.

(10) Patent No.: US 6,785,481 B2
(45) Date of Patent: Aug. 31, 2004

(54) DEVELOPER HOUSING WITH VARIABLE SPEED MIXING FOR IMPROVING MATERIAL LIFE AND PERFORMANCE

(75) Inventors: Daniel M. Bray, Rochester, NY (US); Paul J. McConville, Webster, NY (US)

(73) Assignee: Xerox Corporation, Stamford, CT (US)

( * ) Notice: Subject to any disclaimer, the term of this patent is extended or adjusted under 35 U.S.C. 154(b) by 141 days.

(21) Appl. No.: 10/134,250

(22) Filed: Apr. 26, 2002

(65) Prior Publication Data

US 2002/0176717 A1 Nov. 28, 2002

Related U.S. Application Data

(60) Provisional application No. 60/286,884, filed on Apr. 27, 2001.

(51) Int. Cl.[7] ..... G03G 15/00
(52) U.S. Cl. ..... 399/49; 399/254; 399/260
(58) Field of Search ..... 399/49, 258, 260, 399/38, 58, 60, 61, 62, 72, 74, 119, 120, 252, 253, 254, 256

(56) References Cited

U.S. PATENT DOCUMENTS 5,204,698 A * 4/1993 LeSueur et al. ..... 347/140
5,708,917 A * 1/1998 Kawai et al. ..... 399/58
5,867,198 A * 2/1999 Gwaltney et al. ..... 347/181
5,937,225 A * 8/1999 Samuels ..... 399/27
6,466,749 B1 * 10/2002 O'Brien ..... 399/27

* cited by examiner

*Primary Examiner*—Hoan Tran
(74) *Attorney, Agent, or Firm*—Lloyd F. Bean, II

(57) ABSTRACT

An apparatus which controls the dispensing in mixing of marking particles into a developer unit used in an electrophotograhic printing machine. In particular, the present invention is directed to a developer housing that includes a variable speed mixing apparatus for improving material life and performance. The quantity of marking particles required to reproduce the document is predicted and the dispensing and mixing of marking particles controlled in response thereto.

7 Claims, 4 Drawing Sheets

DEVELOPER HOUSING WITH VARIABLE SPEED MIXING FOR IMPROVING MATERIAL LIFE AND PERFORMANCE

This application is based on a Provisional Patent Application No. 60/286,884, filed Apr. 27, 2001.

This invention relates generally to an electrophotographic printing machine, and more particularly concerns an apparatus for controlling dispensing and mixing of marking particles into a developer unit.

In a typical electrophotographic printing process, a photoconductive member is sensitized by charging its surface to a substantially uniform potential. The charged portion of the photoconductive member is exposed to a light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In most two component development processes, the developer/toner materials are at the mercy of the development housing design: auger configuration, sump geometry, magnetic brush roll size, magnetics design, roll and auger velocity, etc. to cause tribocharging of the toner against the carrier. The auger speeds and roll velocities are usually adjusted to the adequate flow balancing of the developer within the housing and developability that provides ample operating latitude, respectively.

Once these speeds are determined, the level of tribocharging of the toner against the carrier is fixed. Hence, to modify the tribocharging, the formulation of the materials are adjusted to provide the desired tribocharging performance. In conventional two-component xerographic development, the ability of a toner material to charge with a given carrier material is quantified as follows: $A_t$=Tribo*(TC+$C_0$) where Tribo is the average charge to mass ratio of toner, TC is the toner concentration in percent by weight, and $C_0$ is a constant. $A_t$ is a critical specification parameter for toner and developer; it tends to vary from batch to batch, with developer age, and with operating relative humidity. The variation with humidity is a special problem with many color toners, since this variation tends to be much larger than with comparable black toners. In general, the higher the $A_t$, the better the material charging. Modification of the developer $A_t$ by changing the material's formulation is a long process whereby the materials must be subjected to a significant amount of both bench and lengthy, and expensive full process experiments before they can be qualified for satisfactory use in a product.

A problem associated with the above system is in accommodating print jobs having wide area coverage requirements or low area coverage requirements. When the document has high area coverage, charging of the fresh toner is reduced due higher toner throughput in the housing which results to increased toner emission from the housing. When the document has low toner coverage, excessive mixing occurs; toner is impacted into the carrier thereby resulting to reduce material life.

An objective to the present invention is to alleviate the above problems and still maintain the adequate flow balancing of the developer within the housing and have developability that provides ample operating latitude.

SUMMARY

In accordance with one aspect of the present invention, there is provided an electrophotographic printing machine having a latent image is recorded on a photoconductive member with the latent image being developed with marking particles by a developer unit, includes: a sump for storing a supply of marking particles; a dispenser for discharging marking particles from said sump into the developer unit; an auger for mixing marking particles in the sump to be transport to a donor member at a predefined mixing rate; an image processor for processing image information of the latent image to be recorded; means for generating a first output signal corresponding to the average area of the image information of the latent image to be recorded; means for recording a test patch; means for developing the test patch with marking particles; means for measuring a density of the test patch; means for generating a second output signal corresponding to the density of the test patch; means, responsive to the first and second output signals, for generating a control signal that is transmitted to said dispenser to regulate dispensing rate of marking particles into the sump; means for generating a third output signal corresponding to the dispensing rate of marking particles into the sump; and means, responsive to the first control signal and dispensing rate, for variably adjusting the predefined mixing rate of the marking particles in the sump, said variably adjusting mean having means, responsive to charging rate, for dynamically tuning said variably adjusting means. Pursuant to another aspect of the features of the present invention, there is provided a method for controlling dispensing and mixing of marking particles to develop a plurality of print jobs to improve material life and performance of the marking particles, the method comprising the steps of: predicting the quantity of marking particles required to reproduce each print job in said plurality of prints jobs; dispensing marking particles to maintain a predefine level in said sump; printing a first print job from said plurality of print jobs; mixing marking particles at a first mixing rate response to the quantity of marking particles required to reproduce said first print job; printing a second print job from said plurality of print jobs; mixing marking particles at a second mixing rate response to the quantity of marking particles required to reproduce said second print job.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
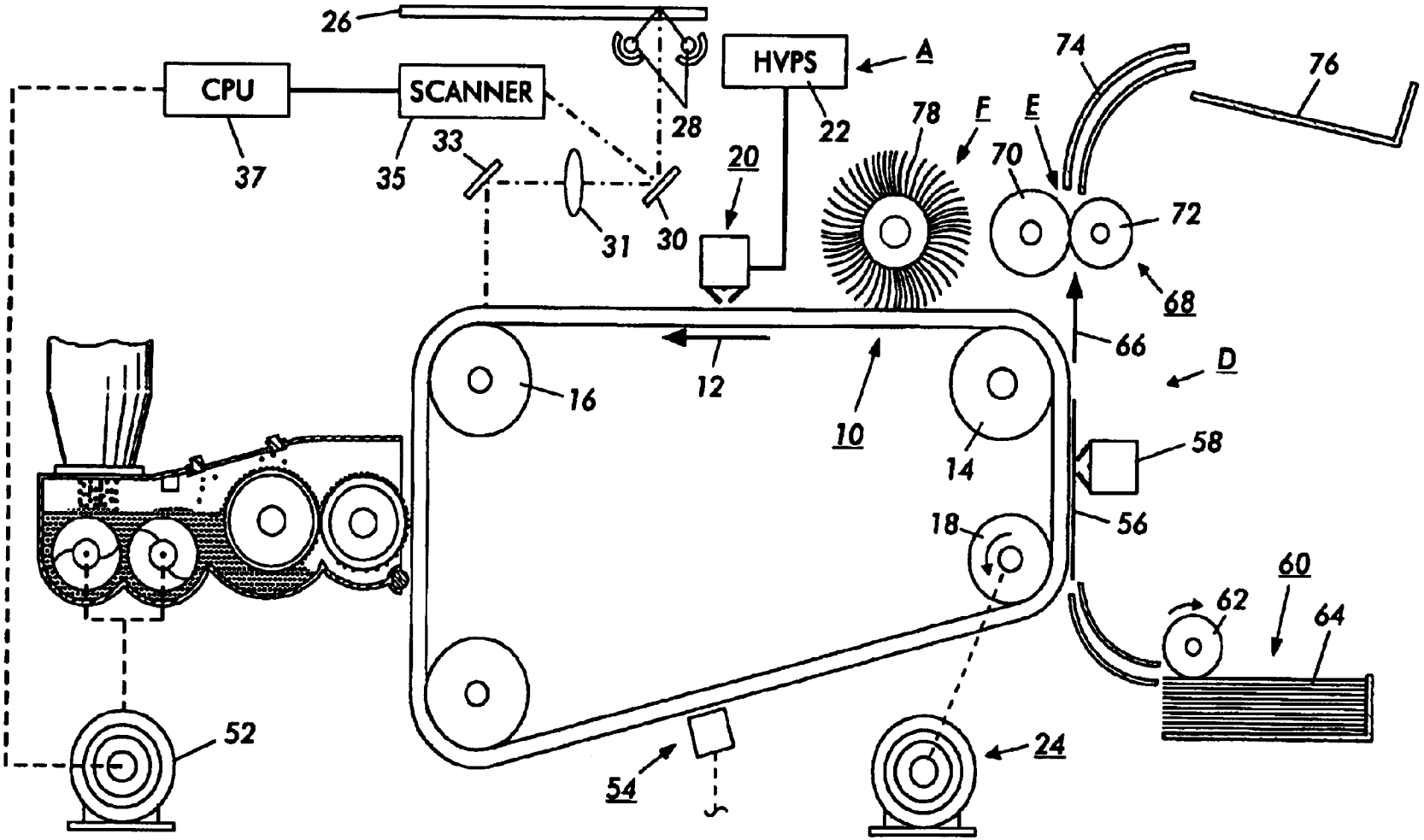
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roller 18 is rotated by a motor coupled thereto by suitable means such as a belt drive.

As drive roller 18 rotates, it advances belt 10 in the direction of arrow 12. Initially, a portion of the photoconductive surface passes through charging station A. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to corona generating device 20. A change in the output of power supply 22 causes corona generating device 20 to vary the charge applied to the photoconductive belt 10.

Next, the charged portion of the photoconductive surface is advanced through imaging station B. At imaging station B, records an electrostatic latent image on the photoconductive belt which corresponds to the informational areas contained within the original document. Scanner 35 is coupled to a centralized processing unit (CPU). The CPU counts the number of dark pixels and light pixels to determine the average amount of toner particles required to develop the latent image.

The CPU processes these signals in a suitable circuit or software and generates an output signal used to anticipate the amount of toner particles required to form a copy of the original document. This output signal controls the dispensing of toner particles into the developer housing. The anticipatory dispensing system is an open loop system which converts the measure of the original area coverage into the amount of toner required. An open loop system of this type can gradually increase or decrease the toner particle concentration within the developer material. This is due to developability varying according to environmental and operator selections in addition to document average coverage requirements. To prevent this from occurring, a closed loop system may be employed in conjunction with the open loop anticipatory system. This is accomplished by having imaging station B include a test area generator, indicated generally by the reference numeral 32. Test area generator 32 comprises a light source and a filter.

The light rays are transmitted through the filter onto the charged portion of photoconductive belt 10, in the inter-image region, i.e. between successive electrostatic latent images recorded on photoconductive belt 10. The filter modulates the light rays from the light source to record a test patch on the photoconductive belt. The test patch recorded on photoconductive belt 10 is a square approximately 5 centimeters by 5 centimeters.

The electrostatic latent image and test patch are then developed with toner particles at development station C. In this way, a toner powder image and a developed test patch is formed on photoconductive belt 10. The developed test patch is subsequently examined to determine the quantity of the toner image being developed on the photoconductive belt.

A densitometer 54 measures the density of the developed test patch and transmits a signal to CPU 37. CPU 37 controls the dispensing of toner particles in response to the signal from the densitometer and from the scanner. At development station C, a magnetic brush development system, indicated generally by the reference numeral 34, advances a developer material into contact with the electrostatic latent image and test patch recorded on photoconductive belt 10.

Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image and test patch attract the toner particles from the carrier granules forming a toner powder image on the latent image and a developed test patch.

As toner particles are depleted from the developer material, a toner particle dispenser, indicated generally by the reference numeral 40, furnishes additional toner particles to housing 42 for subsequent use by developer rollers 36 and 38, respectively. Toner dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. Actuation of motor 52 is controlled by CPU 37.

Densitometer 54, positioned adjacent the photoconductive belt between developer station C and transfer station D, generates electrical signals proportional to the developed test patch density. These signals are conveyed to a control system and suitably processed for regulating the processing stations of the printing machine. Preferably, densitometer 54 is an infrared densitometer. The infrared densitometer is energized at 15 volts DC and about 50 milliamps. The surface of the infrared densitometer is about 7 millimeters from the surface of photoconductive belt 10. Densitometer 54 includes a semiconductor light emitting diode having a 940 nanometer peak output wavelength with a 60 nanometer one-half power bandwidth. The power output is approximately 45 milliwatts. A photodiode receives the light rays reflected from the developed half tone test patch and converts the measured light ray input to an electrical output signal. The infrared densitometer is also used to periodically measure the light rays reflected from the bare photoconductive surface, i.e. without developed toner particles, to provide a reference level for calculation of the signal ratio.

After development, the toner powder image is advanced to transfer station D. At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute 66. Chute 66 guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74, guides the advancing sheet 56 to catch tray 76 for subsequent removal from the printing machine by the operator. After the copy sheet is separated from photoconductive belt 10, the residual toner particles and the toner particles adhering to the test patch are cleaned from photoconductive belt 10. These particles are removed from photoconductive belt 10 at cleaning station F.

Cleaning station F includes a rotatably mounted fibrous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle. It is believed that the foregoing description is sufficient for purposes of the present application to illustrate the general operation of an electrophotographic printing machine incorporating the features of the present invention therein.

Figure 2:
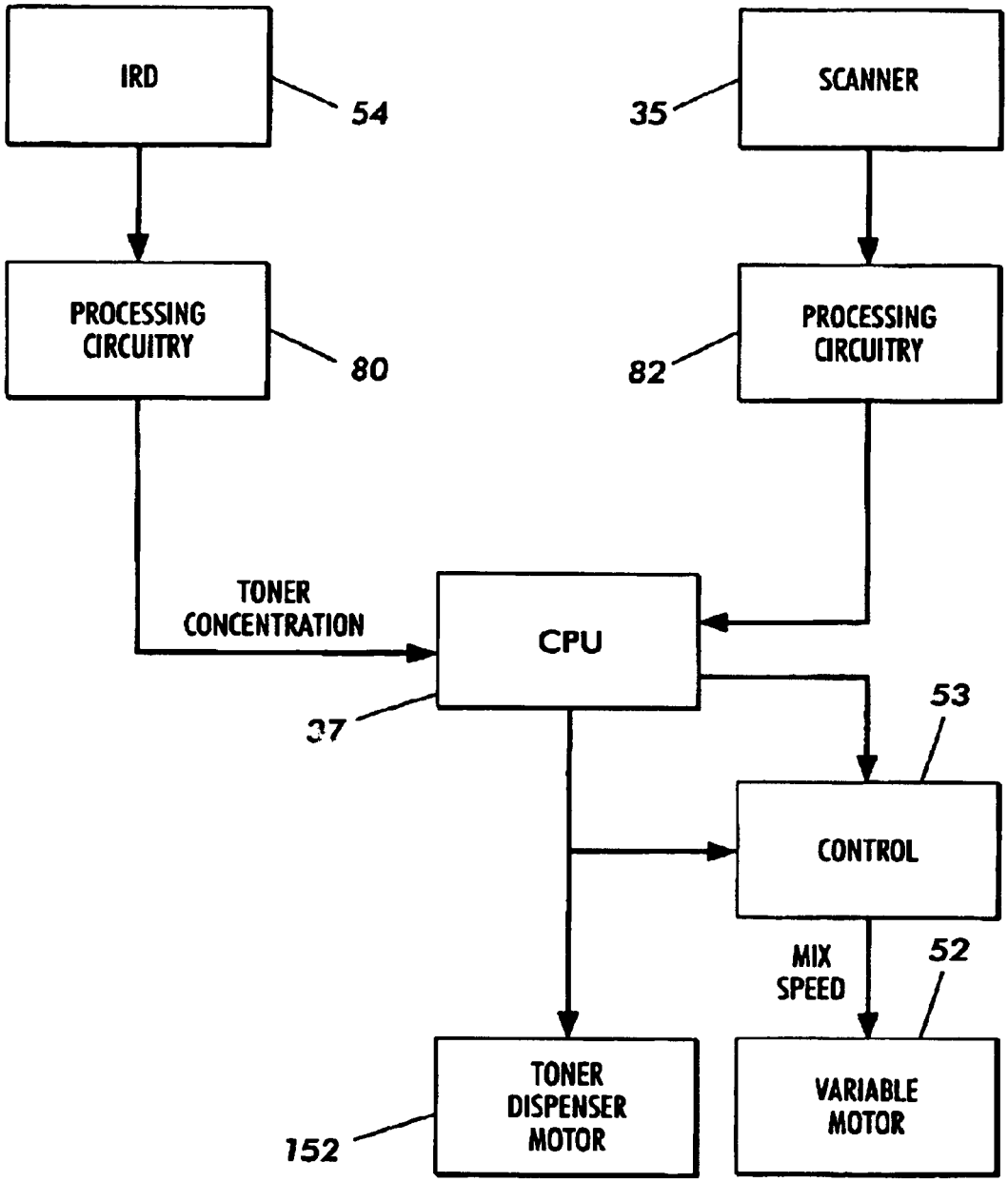
FIG. 2 is a block diagram showing the control system used in the FIG. 1 printing machine.
Figure 3:
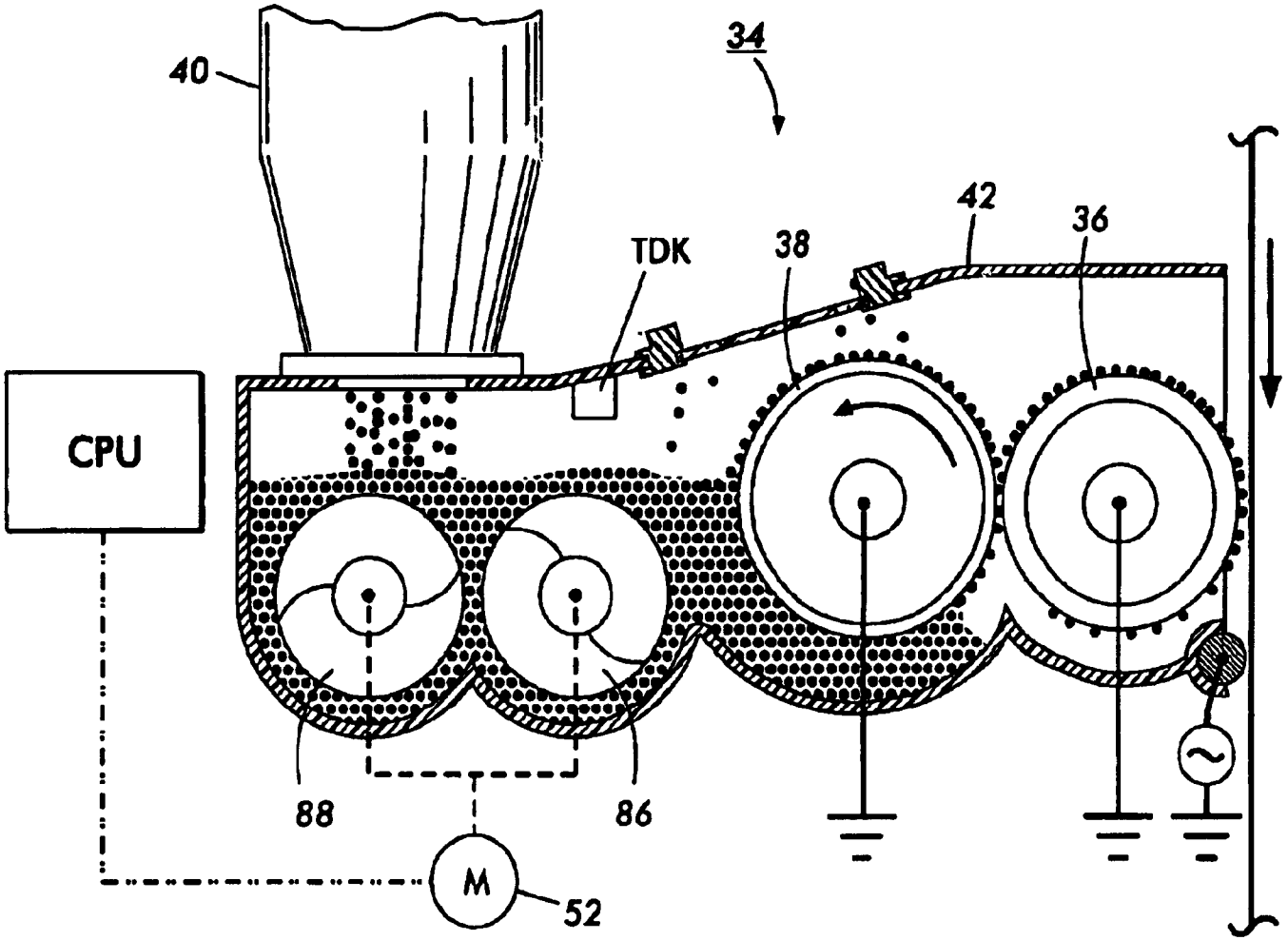
FIG. 3 is a schematic of the developer united employed with the present invention.

Referring now to FIG. 2, infrared densitometer 54 detects the density of the developed test patch and produces an electrical output signal indicative thereof. In addition, an electrical output signal is periodically generated by infrared densitometer 54 corresponding to the bare or undeveloped photoconductive surface. These signals are conveyed to CPU 37 through suitable processing circuitry 80. Processing circuitry 80 forms the ratio of the developed test patch signal/bare photoconductive surface signal and generates electrical error signals proportional thereto. The error signal is transmitted to CPU 37 which processes the error signal so that it controls toner dispenser motor 152. Energization of motor 152 causes toner dispenser 40 to discharge toner particles into developer housing 42. This increases the concentration of toner particles in the developer mixture.

Scanner 35 measures the average area of the original document that is to be covered with toner particles and develops a reference level indicative of the background level of a blank copy sheet. These signals are converted by processing circuitry 82 into a signal which is proportional to the document pixel count. This signal is then transmitted to CPU 37.

CPU 37 develops a control signal in response to the pixel count signal from processing circuitry 82 for regulating the energization of toner dispenser motor 40. The signal from processing circuitry 82 varies for each original document being reproduced in the printing machine whereas the signal from processing circuitry 80 varies slowly as the concentration of toner particles in the developer mixture deviates from the desired level.

A feature of the present invention is that the performance of development housing can be improved by adding a variable drive to the mix in sections of the development unit. The rate (speed) which the mixing section is driven can be determined by monitoring the fresh toner dispense rate. And, by using the pixel counting as an anticipator input. The CPU uses both of these inputs to increase or decrease the mixing rate of augers 88 and 86 by variable speed motor 52 by dynamically turning the mixing in response to a calculated charging rate. The present invention makes it possible to have smaller housing and still provide adequate material life. The present invention also lowers the required trickle rate to maintain the material properties. This rate is usually driven by toner and material, and action at low area of coverage.

In one embodiment of the invention, the magnetic roll 38 and donor roll 36 are driven at a constant speed. Only the mixing section would be changed as a function of the throughput rate. The throughput rate is the rate at which toner is flowing through development subsystem.

Figure 4:
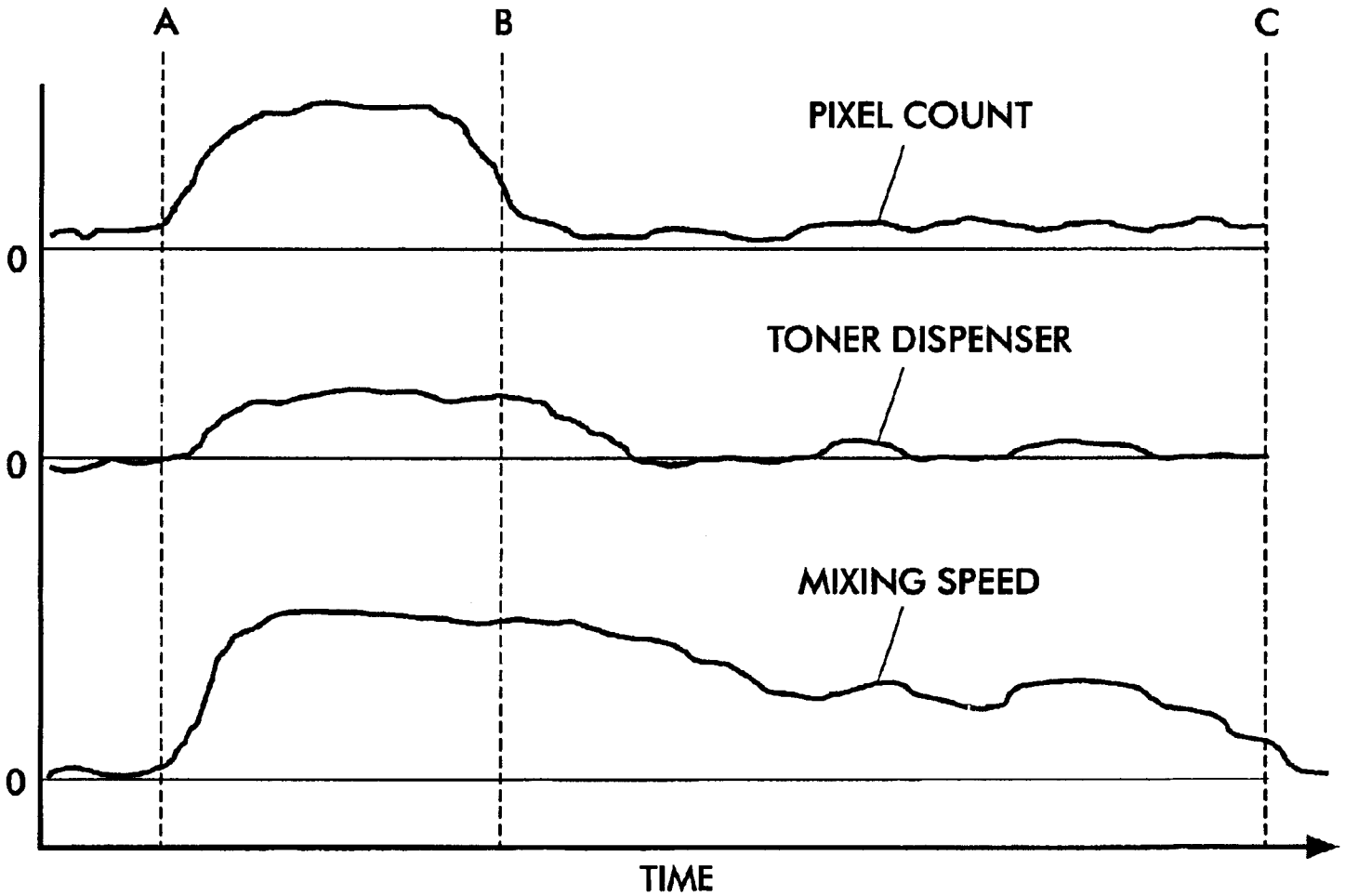
FIG. 4 shows a mixing rate being tuned in respect to the dispensing rate and pixel count.

The requirement to increase the material life at low toner throughput rates by not impacting toner into the carrier. During high area of coverage operation, the mixing speed is increased so as to provide adequate mixing in charging of fresh toner. And conversely, during low coverage operation the mixing speed is decreased so as to provide adequate mixing of charge of the fresh toner, but minimize material impaction and abuse. FIG. 4 shows a mixing rate being tune in respect to the dispensing rate and pixel count. The printing device is running at very low area of coverage. Note the dispenser is off and the development housing is at minimum speed. At Time A, High area coverage documents are being produced and the dispense rate starts to increase. In response to this, the development housing mix section increases to maximum speed and maintains this until Time Point B.

The printer returns to a low area coverage mode and the development mixing section gradually slows down. This slow down time will depend on how fast the material is capable of charging fresh toner (could be 10 seconds or up to 5 or 10 minutes). The rate of charging will also be dependent on how large the developer sump is. Point C shows the mixing speed at the minimum once again. This minimum speed required a certain amount of time to reach and was dependent on low dispense rate, low pixel count, specific housing design, and material volume and charge rate. All of these parameters can be measured, which will allow the controller to be tuned for best performance.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An electrophotographic printing machine having a latent image is recorded on a photoconductive member with the latent image being developed with marking particles by a developer unit, includes:

a sump for storing a supply of marking particles;

a dispenser for discharging marking particles from said sump into the developer unit;

an auger for mixing marking particles in the sump to be transported to a donor member at a predefined mixing rate;

an image processor for processing image information of the latent image to be recorded;

means for generating a first output signal corresponding to the coverage area of the image information of the latent image to be recorded;

means for recording a test patch;

means for developing the test patch with marking particles; and means for measuring a density of the test patch;

means for generating a second output signal corresponding to the density of the test patch;

means, responsive to the first and second output signals, for generating a control signal that is transmitted to said dispenser to regulate dispensing rate of marking particles into the sump;

means for generating a third output signal corresponding to the dispensing rate of marking particles into the sump; and means, responsive to the control signal and dispensing rate, for variably adjusting the predefined mixing rate of the marking particles in the sump, said variably adjusting mean having means, responsive to charging rate, for dynamically tuning said variably adjusting means.

2. A printing machine according to claim 1, wherein said auger includes a variable speed motor, connected to the auger, for rotating the auger to generate said dynamically vary mixing rate.

3. A printing machine according to claim 1, wherein said image processor includes a raster input scanner.

4. A printing machine according to claim 1, wherein said second output signal generating means receives the signal from said measuring means and, in response thereto, generates another control signal that is transmitted to said dispenser;

means for generating an output signal corresponding to the TC and toner charge in the developer unit;

a sensor for measuring a TC and toner charge of the toner in the developer unit.

5. A developer unit having a sump for storing toner, including:

a pixel counter for determining amount of toner required for a print job;

a toner dispenser for supplying toner to said sump at a dispensing rate; and means, responsive to said pixel counter and said dispensing rate, for variably mixing said toner in said sump.

6. The developer unit of claim 5, wherein said variably mixing means includes: an auger disposed in said sump, and a viable speed auger connected thereto.

7. A method for controlling dispensing and mixing of marking particles in a sump to develop a plurality of print jobs to improve material life and performance of the marking particles, the method comprising the steps of:

predicting the quantity of marking particles required to reproduce each print job in said plurality of prints jobs;

dispensing marking particles to maintain a predefined level in said sump;

printing a first print job from said plurality of print jobs;

mixing marking particles at a first mixing rate response to the quantity of marking particles required to reproduce said first print job;

printing a second print job from said plurality of print jobs;

mixing marking particles at a second mixing rate response to the quantity of marking particles required to reproduce said second print job.

* * * * *